US009750386B2

(12) United States Patent
Zeng et al.

(10) Patent No.: US 9,750,386 B2
(45) Date of Patent: Sep. 5, 2017

(54) FOLDABLE SPIN FLAT MOP AND CLEANING TOOL INCLUDING SAME

(71) Applicant: 3M INNOVATIVE PROPERTIES COMPANY, St. Paul, MN (US)

(72) Inventors: Feng Zeng, Shanghai (CN); Xiaolin Yin, Shanghai (CN); Peng Wu, Guangzhou (CN)

( * ) Notice: Subject to any disclaimer, the term of this patent is extended or adjusted under 35 U.S.C. 154(b) by 235 days.

(21) Appl. No.: 14/434,358

(22) PCT Filed: Oct. 10, 2013

(86) PCT No.: PCT/US2013/064276
§ 371 (c)(1),
(2) Date: Apr. 8, 2015

(87) PCT Pub. No.: WO2014/059105
PCT Pub. Date: Apr. 17, 2014

(65) Prior Publication Data

US 2015/0272419 A1 Oct. 1, 2015

(30) Foreign Application Priority Data

Oct. 11, 2012 (CN) ..... 2012 2 0520683 U

(51) Int. Cl.
*A47L 13/258* (2006.01)
*A47L 13/58* (2006.01)
*A47L 13/256* (2006.01)

(52) U.S. Cl.
CPC ..... *A47L 13/258* (2013.01); *A47L 13/256* (2013.01); *A47L 13/58* (2013.01)

(58) Field of Classification Search
CPC ..... A47L 13/14; A47L 13/20; A47L 13/24; A47L 13/254; A47L 13/255; A47L 13/256; A47L 13/258
(Continued)

(56) References Cited

U.S. PATENT DOCUMENTS 6,588,956 B1 * 7/2003 Gennuso, Jr. ..... A47L 13/20 15/144.1
8,356,379 B2 1/2013 Fischer
(Continued)

FOREIGN PATENT DOCUMENTS

CN 2455190 10/2001
DE 19921661 11/2000
(Continued)

OTHER PUBLICATIONS

European Search Report for European Patent Application No. 13 84 4614.1 mailed on Apr. 27, 2016, 6pages.
(Continued)

*Primary Examiner* — Mark Spisich

(57) ABSTRACT

A foldable spin flat mop (100) is disclosed that comprises a handle (10); and a mop head (20) connected to the handle. The mop head comprises: at least two independent cleaning plates (21), which together being able to form a coplanar and flat cleaning flat surface; and a connection mechanism disposed to rotatably connect the at least two independent cleaning plates to the handle. The connection mechanism comprises: a plurality of seats (23) provided respectively at the at least two independent cleaning plates; and at least one joint member (24) connecting the plurality of seats; wherein each of the at least two independent cleaning plates is rotatable with regard to the joint member, such that the at least two independent cleaning plates each is capable of freely rotating relative to the handle.

8 Claims, 6 Drawing Sheets

(58) Field of Classification Search
USPC ..... 15/119.1, 147.1, 147.2, 149, 228, 229.1, 15/229.6–229.8
See application file for complete search history.

(56) References Cited

U.S. PATENT DOCUMENTS

| | | | | |
|---|---|---|---|---|
| 8,793,834 | B2 | 8/2014 | Lee | |
| 2006/0196001 | A1 | 9/2006 | Demirtas | |
| 2006/0288508 | A1 | 12/2006 | Knopow | |
| 2007/0240270 | A1* | 10/2007 | Urbano | A47L 13/258 15/119.1 |
| 2009/0158544 | A1* | 6/2009 | Pagani | A47L 13/258 15/228 |
| 2012/0073074 | A1 | 3/2012 | Hsu | |
| 2013/0067673 | A1* | 3/2013 | Yu | A47L 13/258 15/228 |

FOREIGN PATENT DOCUMENTS

| | | | |
|---|---|---|---|
| EP | 0050801 | | 5/1982 |
| EP | 0980667 | | 2/2000 |
| FR | 2030457 | * | 11/1970 |
| JP | 10-33444 | * | 2/1998 |
| JP | 10-43114 | * | 2/1998 |
| JP | 10-286208 | * | 10/1998 |
| JP | 2004-201716 | * | 7/2004 |
| JP | 2013-75036 | * | 4/2013 |
| KR | 2012-0000360 | | 1/2012 |
| WO | WO 98/40004 | | 9/1998 |
| WO | 2006/002654 | * | 1/2006 |

OTHER PUBLICATIONS

International Search Report for PCT International Application No. PCT/US2013/064276 mailed on Jan. 28, 2014, 4 pages.

* cited by examiner

FOLDABLE SPIN FLAT MOP AND CLEANING TOOL INCLUDING SAME

FIELD OF THE INVENTION

The present disclosure generally relates to a cleaning tool, and in particular, to a foldable spin flat mop suitable for centrifugal dehydration.

DESCRIPTION OF THE RELATED ART

Spin circular mop set is one of the most popular cleaning tools in the market of household articles. Normally, a circular mop set includes a bucket and a circular mop. The circular mop comprises a handle, a cleaning part and a mop head connected therebetween. The bucket includes a bucket chamber and a rotatable basket. The bucket chamber both receives water from the cleaning part and holds water for washing the cleaning part. The rotatable basket is fixed to the bucket chamber and is configured to be matchable with the cleaning part of the mop. Once the cleaning part of the mop is fitted onto the rotatable basket, by rotation of the cleaning part together with the rotatable basket, the cleaning part is dehydrated by centrifugal effect. Consequently, this mop set can realize washing and dehydrating of the cleaning part without removing it from the mop head, which means that the user has no need to touch the cleaning part during washing and dehydrating of the cleaning part. In other words, this circular mop set enables a user to wash the cleaning part of the circular mop without touching the cleaning part by hand, which not only makes the washing more convenient, but also keeps the user's hands clean.

On the other hand, the flat mop is an important member of the mop family. Generally speaking, a flat mop is especially suitable for removing dusts around corners and between crevices. Also, a flat mop may be used for cleaning window glasses. However, like a conventional circular mop, it is also inconvenient to wash and dehydrate a conventional flat mop. Specifically, the cleaning part of a conventional flat mop needs to be detached from the mop head before it can be washed by hand and dehydrated. To solve this problem, a kind of spin flat mop is developed. Similar to the spin circular mops, this spin flat mop is foldable and thus can be placed into a rotatable basket for centrifugal dehydration. FIG. 1 illustrates an embodiment of this kind of spin flat mop. As shown in FIG. 1, the flat mop includes a handle 1 and a mop head connected to the handle by a cardan joint 4. The flat mop's head is made up of three plates 2, 3, which are connected side-by-side to form a coplanar and flat cleaning part. In these plates, a middle plate 2 is connected to a mop handle 1 through the cardan joint 4, and the other two side plates 3 are hinged to the middle plate 2 such that they can rotate upwardly and downwardly with respect to the middle plate 2 when an external force is applied thereon. Also, there are springs deployed at the joints between the side plates 3 and the middle plate 2, which keeps the three plates coplanar when no external force is applied thereupon. In addition, when installed with a microfiber bonnet 5, this foldable spin flat mop can act as a normal flat mop. As shown in FIG. 2, once an external force is applied on the side plates 3, the three-plate mop head will be transferred into a "U" form to fit onto the rotatable basket 6, and then rotate to spray water out. However, though this foldable spin flat mop can realize washing and dehydrating of the microfiber bonnet 5 without touching the microfiber bonnet by hand, only the microfiber bonnet attached onto the middle plate 2 can function well for floor cleaning, because the side plates may sway up and down during cleaning. This means that the force from the user is not effectively transferred to the two side plates 3. Therefore, the cleaning efficiency of this foldable spin flat mop is affected. Moreover, when in dehydration, only the side plates 3 of this foldable spin flat mop which lean against the side wall of the rotatable basket 6 can be dehydrated well, and the middle plate 2 usually cannot be fully dehydrated. In view of these shortcomings, a foldable spin flat mop with higher cleaning and dehydration efficiency needs to be developed.

SUMMARY OF THE INVENTION

The disclosed foldable spin flat mop has been made to overcome or alleviate at least one aspect of the above mentioned disadvantages existing in the conventional technical solutions. The disclosed foldable spin flat mop is simple in structure and has improved cleaning and dehydration efficiency. The foldable spin flat mop may be transited between a cleaning state and a dehydration state. Specifically, when the foldable spin flat mop is in the dehydration state, its cleaning part (i.e., these independent cleaning plates and the cleaning elements attached thereon) may be folded to enable it to be placed into a rotatable basket of a bucket, thereby realizing the centrifugal dehydration.

Apart from the above-mentioned foldable spin flat mop, a cleaning tool kit including this foldable spin flat mop is also provided.

In one embodiment, there is provided a foldable spin flat mop, comprising:

- a handle; and
- a mop head connected to said handle, said mop head comprising:
  - at least two independent cleaning plates being able to form a coplanar and flat cleaning surface; and
  - a connection mechanism disposed to rotatably connect said at least two independent cleaning plates to said handle, said connection mechanism comprising:
    - a plurality of seats provided respectively at said at least two independent cleaning plates; and
    - at least one joint member connecting the plurality of seats;
    - wherein each of said at least two independent cleaning plates is rotatable with regard to said joint member, such that said at least two independent cleaning plates each is capable of rotating relative to said handle.

In one embodiment, each of said at least one joint member has an "H"-shaped configuration, which includes a straight joint body connected to said handle, and two end joint bodies respectively disposed upon a corresponding one of said at least two independent cleaning plates and respectively connected to the seats of the corresponding one of said at least two independent cleaning plates.

In one embodiment, in each of said at least one joint member, said two end joint bodies each connects with the straight joint body and defines a pivotal axis perpendicular to the straight joint body, and each of said at least two independent cleaning plates is rotatable around its corresponding pivotal axis.

In one embodiment, said connection mechanism further comprising: a cardan joint member connecting said joint member to said handle, said cardan joint member is configured to be rotatable around a second axis perpendicular to the straight joint body and extending through the cardan joint member, and be rotatable around the straight joint body.

In one embodiment, in each of said at least two independent cleaning plates, the distance between the end joint body and the handle is less than the distance between a vertical centre line of the independent cleaning plate and said handle.

In one embodiment, in each of said at least two independent cleaning plates, the distance between the end joint body and the handle is greater than or equal to the distance between a vertical centre line of the independent cleaning plate and the handle, and the connection mechanism further comprises a bias unit adapted to bias the corresponding one of said at least two independent cleaning plates to keep them in a coplanar state.

In one embodiment, the bias unit comprises butterfly springs each of which slips over a corresponding one of the end joint bodies.

In one embodiment, the foldable spin flat mop further comprises cleaning elements each of which is installed to a corresponding one of said at least two independent cleaning plates. Preferably, each of the cleaning elements comprises a microfiber bonnet.

In one embodiment, a cleaning tool kit in which the aforementioned foldable spin flat mop is included. The cleaning tool kit comprises:

a foldable spin flat mop as mentioned above; and a bucket including a bucket chamber and a rotatable basket disposed in said bucket chamber; wherein when the mop head of the foldable spin flat mop is placed into the rotatable basket, each of said at least two independent cleaning plates will rotate around its corresponding end joint body to lean against the side wall of the basket, such that once the mop head together with the basket is driven to gyrate, the centrifugal dehydration of the mop head is performed.

The disclosed foldable spin flat mop is simple in structure. Specifically, the foldable spin flat mop may include two or more independent cleaning plates in the mop head. By attaching these independent cleaning plates to the handle of the mop, the independent cleaning plates may be transitioned between a cleaning state and a dehydration state. Further, since all of these independent cleaning plates can be placed into the rotatable basket and rotate with the basket, the microfiber bonnets (i.e., the cleaning element) attached to these independent cleaning plates can be dehydrated effectively. Accordingly, a higher dehydration efficiency can be achieved. Furthermore, once an external force is applied on the handle, the force may be evenly transferred to all independent cleaning plates. Therefore, this foldable spin flat mop has higher cleaning efficiency compared with prior art.

BRIEF DESCRIPTION OF THE DRAWINGS

These and/or other aspects and advantages of the invention will become apparent and more readily appreciated from the following description of the embodiments, taken in conjunction with the accompanying drawings of which.

Figure 1:
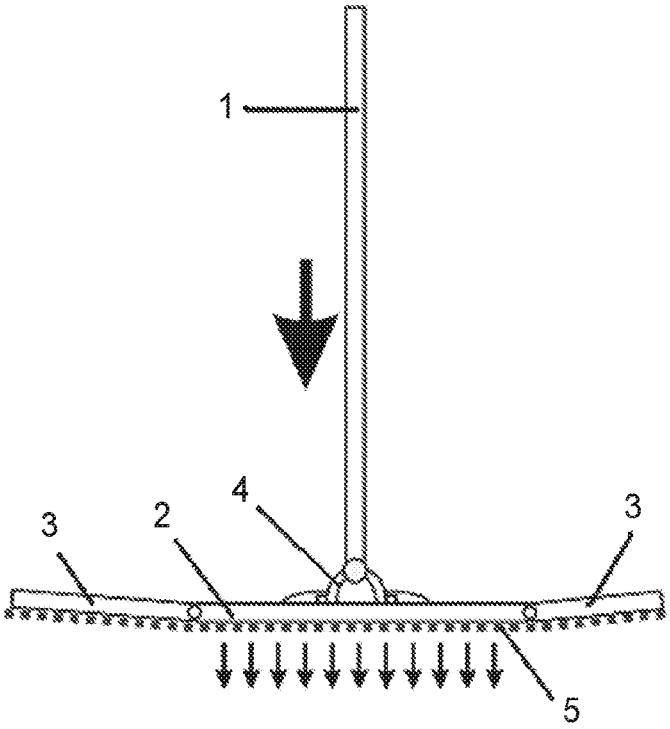
FIG. 1 Prior Art
FIG. 1 is a schematic view of a conventional spin flat mop in prior art.

The scope of the present invention will in no way be limited to the embodiments as set forth herein. In the disclosed embodiments, the particulars of the foldable spin flat mop are disclosed in detail for the purpose of illustration only.

DETAILED DESCRIPTION OF PREFERRED EMBODIMENTS OF THE INVENTION

Exemplary embodiments of the present disclosure will be described hereinafter in detail with reference to the attached drawings, wherein like reference numerals refer to like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

FIGS. 3-7 show a foldable spin flat mop 100. The foldable spin flat mop 100 comprises a handle 10 and a mop head 20 connected to the handle 10. The mop head 20 comprises at least two independent cleaning plates 21 and a connection mechanism disposed to rotatablely connect the at least two independent cleaning plates 21 to the handle 10, wherein the at least two independent cleaning plates 21 together are able to form a coplanar and flat cleaning surface. In the mop head 20, the connection mechanism comprises: a plurality of seats 23 provided respectively at the at least two independent cleaning plates 21; and at least one joint member 24 connecting the plurality of seats 21; wherein each of the at least two independent cleaning plates 21 is rotatable with regard to the joint member 24, such that the at least two independent cleaning plates 21 each is capable of freely rotating relative to the handle 10. Accordingly, the foldable spin flat mop according to the present invention can be transitioned between a cleaning state (in which all of these independent cleaning plates 21 are coplanar) and a dehydration state (in which all of these independent cleaning plates 21 are folded to be placed into a rotatable basket of a bucket).

Specifically, as shown in FIGS. 3-7, in the foldable spin flat mop 100, the joint member 24 has a "H"-shaped configuration. In particular, the "H"-shaped joint member 24 includes a straight joint body 241 connected to the handle 10 and two end joint bodies 242 respectively disposed upon a corresponding one of the independent cleaning plates and respectively connected to the seats 23 of the corresponding one of the independent cleaning plates 21; wherein the two end joint bodies 242 each defines a pivotal axis X1 perpendicular to the straight joint body, and each of the two independent cleaning plates 21 is rotatable around its corresponding pivotal axis X1. In this embodiment, only one "H"-shaped joint member 24 is provided, and two independent cleaning plates 21 are connected together by this "H"-shaped joint member 24.

Nevertheless, in an alternative embodiment, there may be more than two independent cleaning plates 21 (say, four or six cleaning plates, for example). Accordingly, more than one "H"-shaped joint members 24 may be provided, for connecting these four or six cleaning plates together. In particular, in the case of four cleaning plates, two "H"-shaped joint members 24 are provided. Each of the "H"-shaped joint members 24 includes a straight joint body 241 and two end joint bodies 242. And two straight joint bodies 241 of the two "H"-shaped joint members 24 are intersected with each other, while the four end joint bodies 242 of the two "H"-shaped joint members 24 are respectively connected to the seats 23 of a corresponding one of these four independent cleaning plates 21. As such, these four independent cleaning plates 21 may be connected together by the two "H"-shaped joint members 24.

As shown in FIGS. 3-7, in the foldable spin flat mop 100, the connection mechanism may further comprise a cardan joint member 22 connecting the joint member 24 to the handle 10. Specifically, the cardan joint member 22 is configured to be rotatable around a second axis X2 perpendicular to the straight joint body 241 and extending through the cardan joint member 22, and rotatable around a third axis X3 which running through the straight joint body (refer to FIG. 6). In other words, the cardan joint member 22 is capable of rotating around the straight joint body 241. Accordingly, the cardan joint member 22 is capable of freely rotating around both the second axis X2 and the straight joint body 241.

As shown in FIGS. 3-7, in the foldable spin flat mop 100, the distance between each of the two end joint bodies 242 of the joint member 24 and the handle 10 is less than the distance between a vertical centre line (no shown) of the corresponding one of the two independent cleaning plates 21 and the handle 10. In this way, when no exterior force is exerted on the two independent cleaning plates 21, they may be kept naturally in a state where the two plates form a coplanar and flat cleaning surface by gravity. Alternatively, in the foldable spin flat mop 100 according to another embodiment, the distance between each of the two end joint bodies 242 of the joint member 24 and the handle 10 may be greater than or equal to the distance between a vertical centre line of the corresponding one of the independent cleaning plates 21 and the handle 10. In this situation, the connection mechanism may further comprises a bias unit (not shown, such as springs) provided at each of the at least two independent cleaning plates 21 and adapted to bias the corresponding one of the at least two independent cleaning plates 21 to keep these plates in a coplanar state when there is no external force applied to these plates. For example, the bias unit can comprise two butterfly springs each of which slips over a corresponding one of the two end joint bodies 242.

Figure 4:
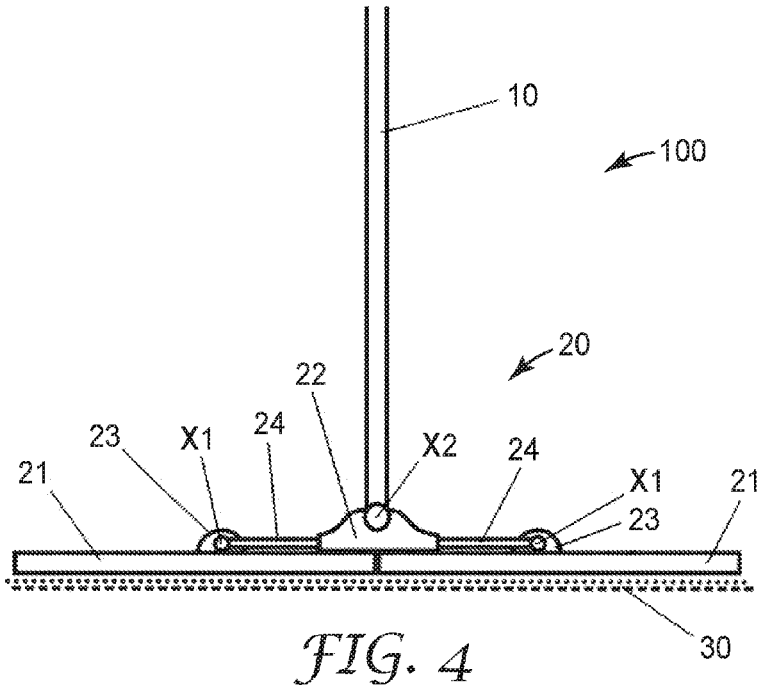
FIG. 4 is a side view of the foldable spin flat mop as shown in FIG. 3, in which the two plates of the mop are coplanar.
Figure 5:
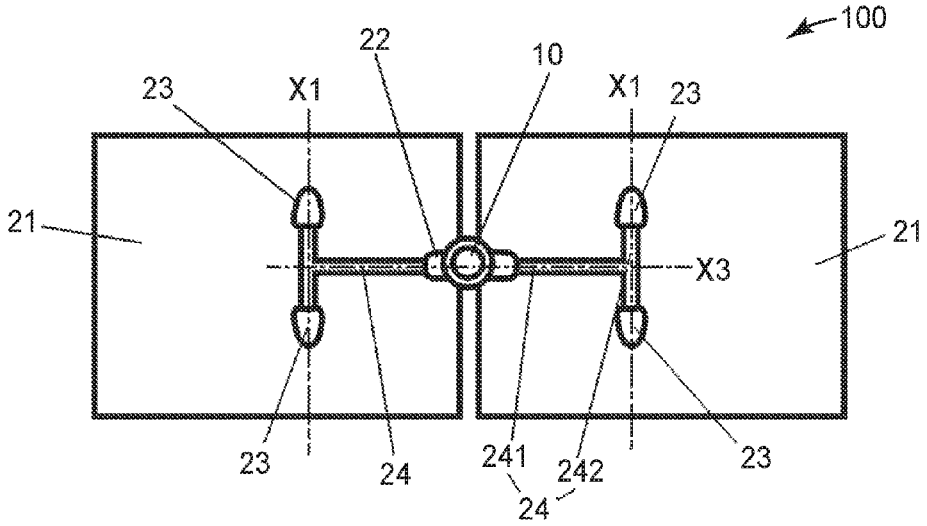
FIG. 5 is a top view of the foldable spin flat mop as shown in FIG. 3, in which the two plates of the mop are coplanar.
Figure 6:
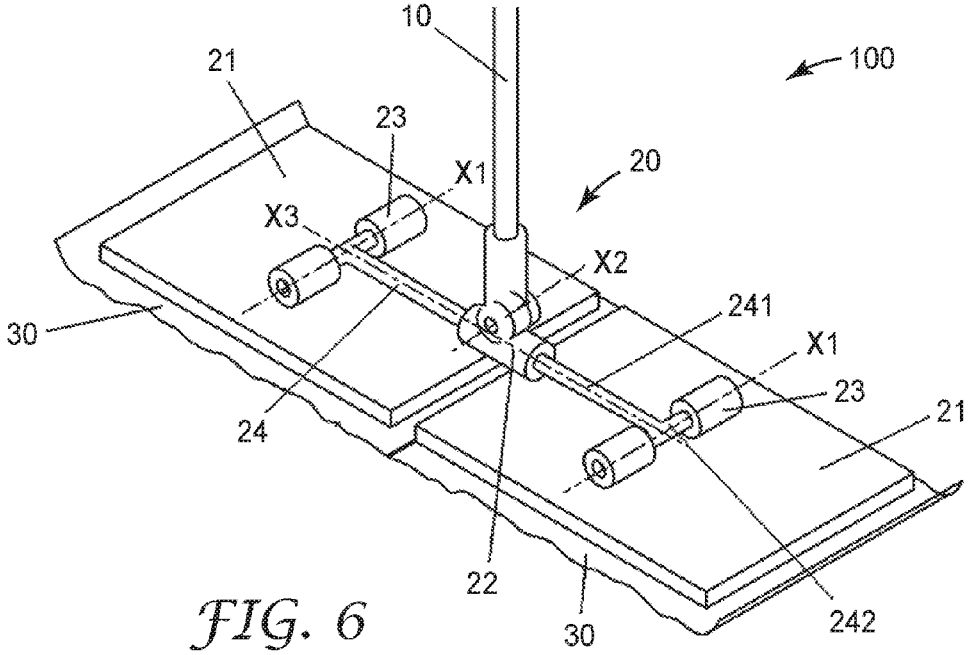
FIG. 6 is a perspective view of the foldable spin flat mop according to a preferred embodiment of the present invention, in which the two plates of the mop are coplanar.

When the foldable spin flat mop 100 is in use, as shown in FIG. 4, a cleaning element 30 is installed to each of the at least two independent cleaning plates 21. Preferably, each of the cleaning elements comprises a microfiber bonnet.

Figure 7:
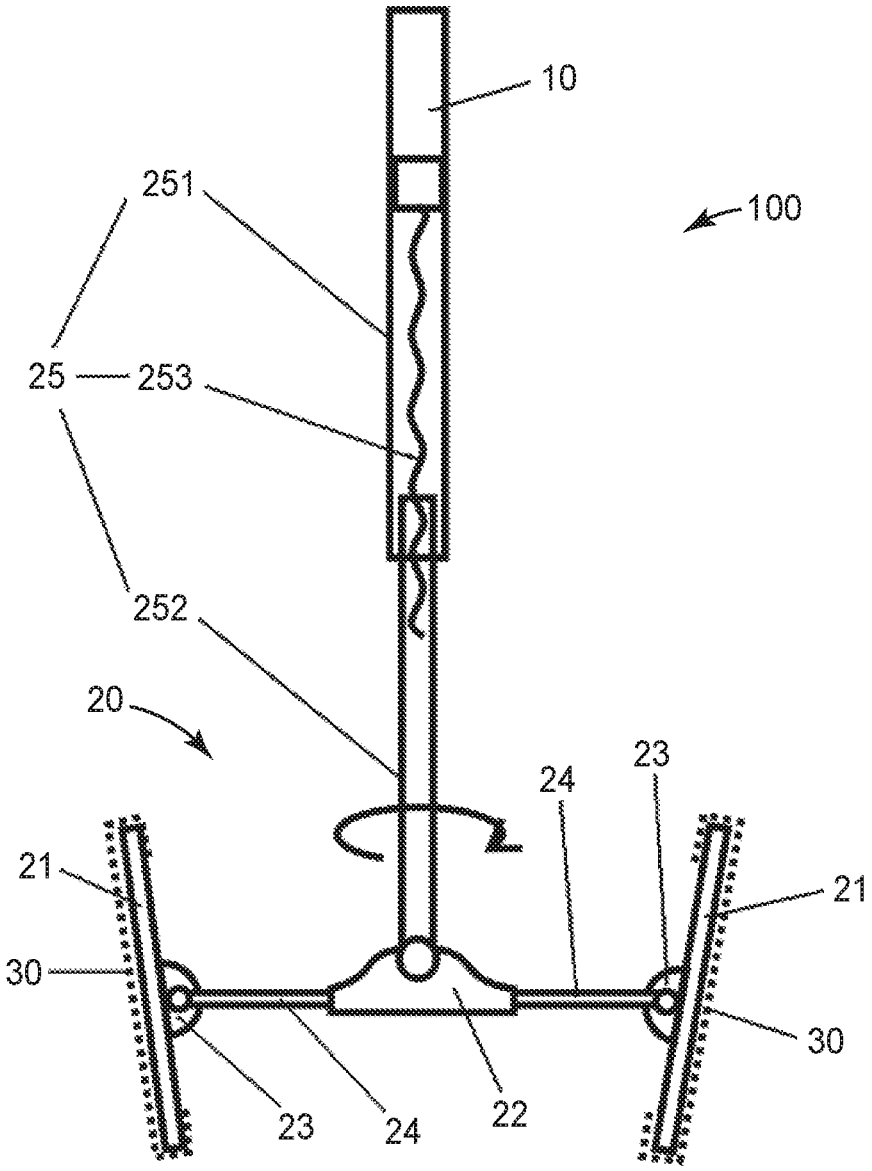
FIG. 7 is another schematic view of the foldable spin flat mop according to a preferred embodiment of the present invention, in which each of the two plates of the mop rotates about its corresponding pivotal axis to a position.

According to FIG. 7, the foldable spin flat mop 100 further comprises a gyration driving mechanism 25 capable of driving the mop head 20 to gyrate. According to a preferred embodiment, the gyration driving mechanism 25 comprises: an outer stick element 251 having a lead screw element 253 mounted therein; and an inner stick element 252 connected to the mop head 20 and comprising threads disposed upon its inner side wall (not shown), these threads being in engagement with the lead screw element 253 of the outer stick element 251. Specifically, an up-down movement of the outer stick element 251 is transferred into a gyrating movement of the inner stick element 252 through the interaction between the lead screw element 253 and the threads disposed upon the inner side wall of the inner stick element, such that the mop head 20 connected to the inner stick element 252 is driven to gyrate. That is, the gyration driving mechanism 25 according to the preferred embodiment is a telescopic gyration driving mechanism. Other gyration driving mechanisms 25, which enable transition of an up-down movement of the handle 10 into a rotation of the mop head 20, may be contemplated. Apart from these, it is also apparent to a person skilled in the art that alternative mechanisms may be adopted. For example, an electric motor may be provided between the outer stick element 251 and the inner stick element 252. And the inner stick element 252 may be driven to rotate by starting the electric motor.

Figure 8:
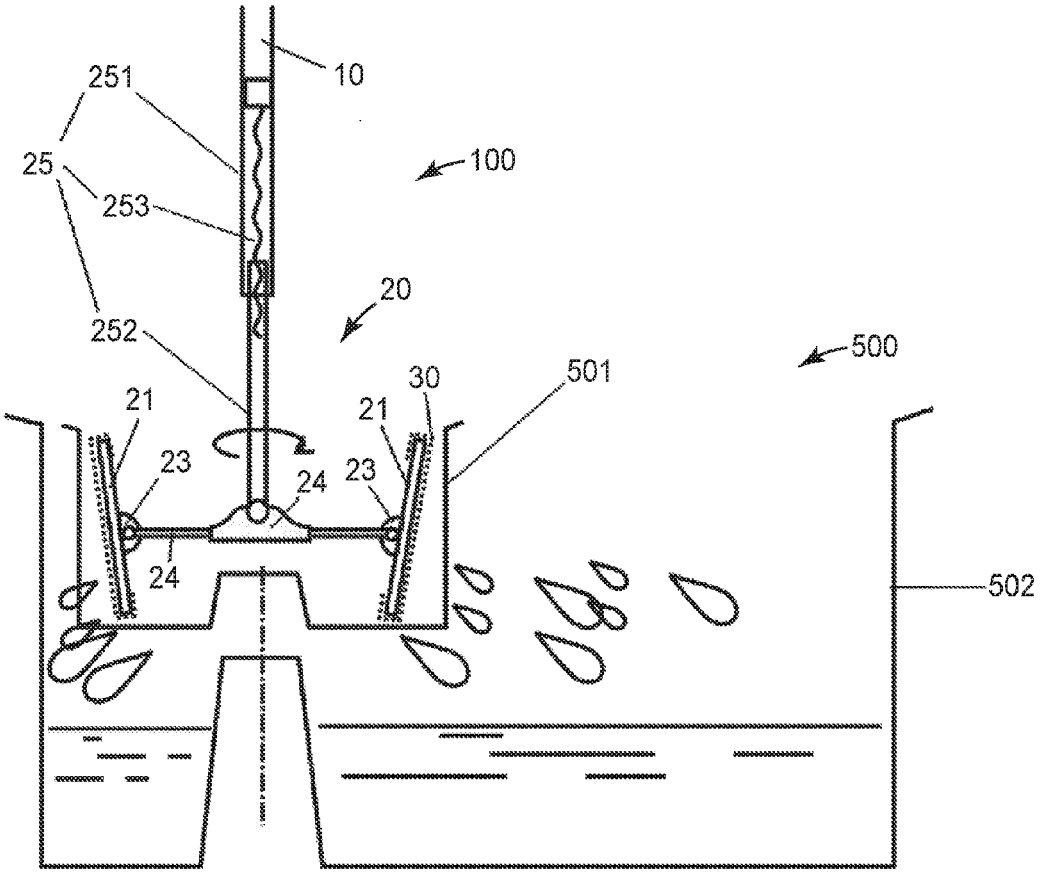
FIG. 8 is a schematic view of the foldable spin flat mop according to a preferred embodiment of the present invention, in which the mop is rested upon a rotatable basket and is being dehydrated.

In one embodiment, a cleaning tool kit in which the aforementioned foldable spin flat mop 100 is included. Specifically, referring to FIG. 8, the cleaning tool kit comprises the aforementioned foldable spin flat mop 100 and a bucket 500. The bucket 500 includes a bucket chamber 502 and a rotatable basket 501 disposed in the bucket chamber 502. And the cleaning tool kit is configured such that, when the mop head 20 of the foldable spin flat mop 100 is fitted to the rotatable basket, each of these independent cleaning plates 21 will rotate around its corresponding end joint body to lean against the side wall of the basket, such that once an external force is applied to the handle of the foldable spin flat mop to drive the mop head to gyrate, the centrifugal dehydration of the cleaning part is performed. That is, as shown in FIG. 8, to dehydrate the foldable spin flat mop 100, the mop head 20 of the foldable spin flat mop 100 is fitted to the rotatable basket 501 such that each of the two independent cleaning plates 21 is transitioned from a horizontal position to a substantially vertical position to lean against the side wall of the rotatable basket 501. Then, by performing the up-down movement of the outer stick element 251 relative to the inner stick element 252, the mop head 20 is driven to gyrate. Consequently, with the gyration of the mop head 20, the rotatable basket 501 of the bucket 500 is rotated in the bucket chamber 502. Thus, the cleaning elements 30 (i.e., the microfiber bonnets) attached to the cleaning plates 21 of the mop head are dehydrated effectively due to centrifugal effect.

Figure 2:
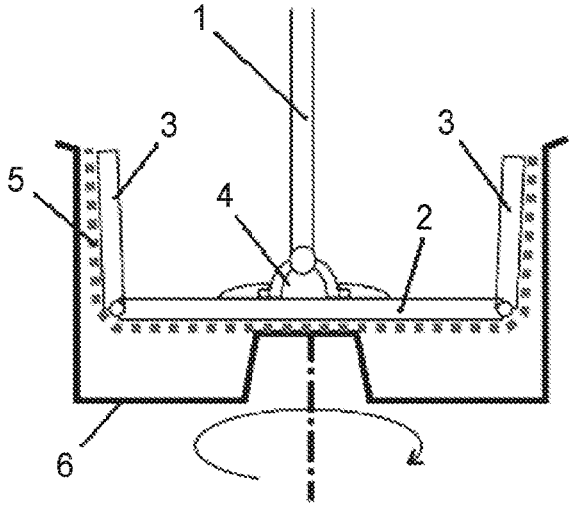
FIG. 2 Prior Art
FIG. 2 is a schematic view of the conventional spin flat mop shown in FIG. 1, in which the mop is rested upon a rotatable basket and is being dehydrated.
Figure 3:
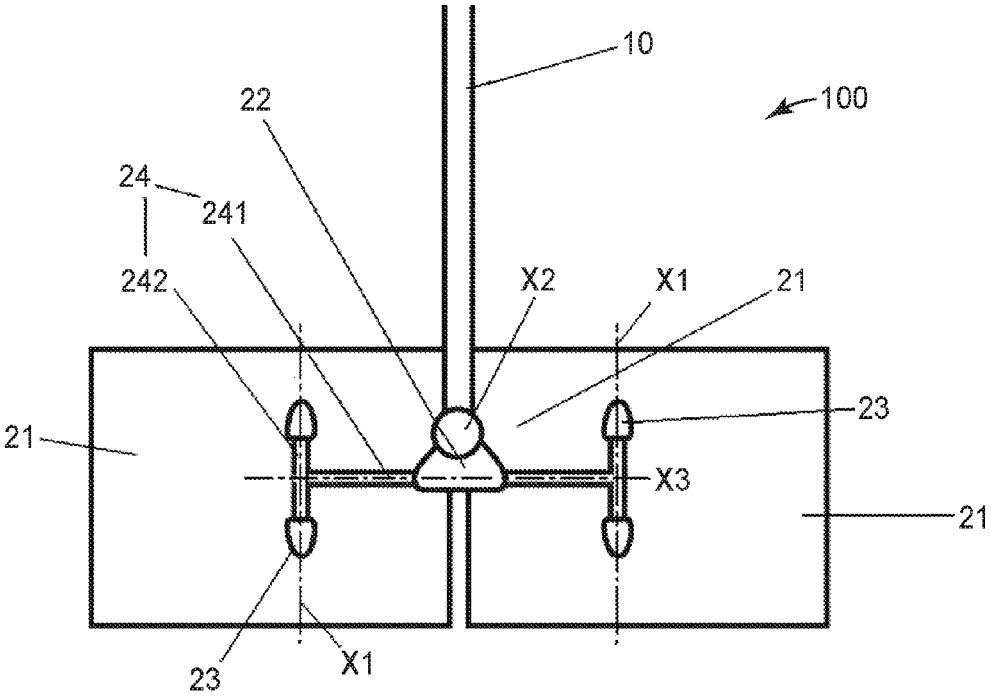
FIG. 3 is a schematic view of a foldable spin flat mop according to a preferred embodiment of the present invention, in which the two plates of the mop are coplanar.
Figure 9:
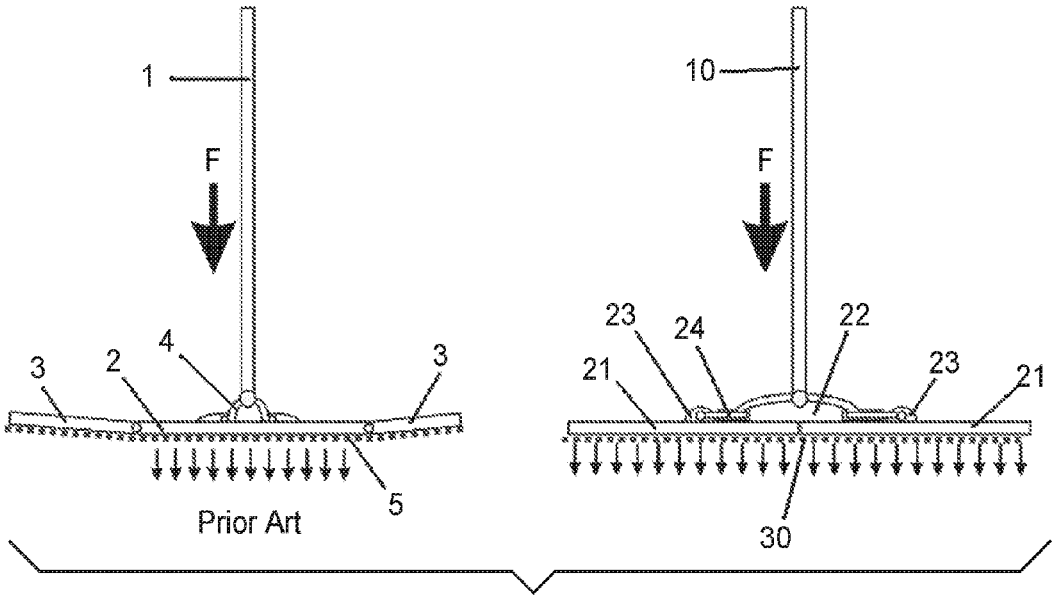
FIG. 9 is a comparative schematic view of the conventional spin flat mop as shown in FIGS. 1 and 2 and the foldable spin flat mop according to the present invention, in which the plates of both of the mops are ready for cleaning.
Figure 10:
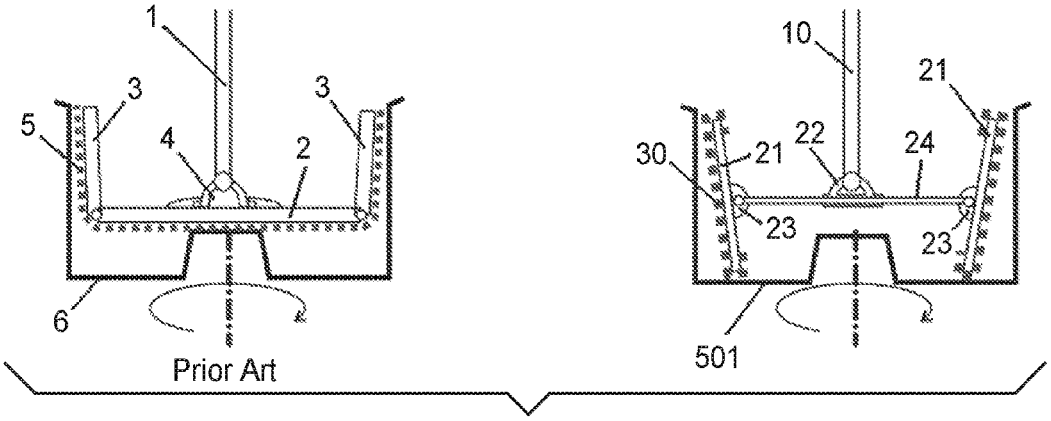
FIG. 10 is another comparative schematic view of the conventional spin flat mop as shown in FIGS. 1 and 2 and the foldable spin flat mop according to the present invention, in which both of the mops are rested upon their respective rotatable baskets and are being dehydrated.

FIGS. 9-10 show comparisons of the conventional spin flat mop as shown in FIGS. 1 and 2 and the foldable spin flat mop, both in the cleaning state and in the dehydration state. Specifically, FIG. 9 is a comparative schematic view of the conventional spin flat mop as shown in FIGS. 1 and 2 and the foldable spin flat mop, both in their cleaning states (in which the plates of both mops are ready for cleaning); while FIG. 10 is another comparative schematic view of the conventional spin flat mop as shown in FIGS. 1 and 2 and the foldable spin flat mop, both in their dehydration states (in which the plates of both mops are rested upon their rotatable baskets and are being dehydrated).

Referring to FIG. 9, the left is the conventional spin flat mop while the right is the foldable spin flat mop 100. For this conventional mop, only the middle plate 2 is directly connected to the mop handle 1, and the other two side plates 3 are hinged to the middle plate 2, and springs are deployed at the joints between the two side plates 3 and the middle plate 2, to keep the two side plates 3 coplanar with the middle plate 2. As shown in FIG. 9, when the conventional spin flat mop is in a cleaning state, i.e., when an external force is exerted on the mop handle 1, the middle plate 2 directly connected to the mop handle 1 can perform the cleaning as a normal flat mop, but the two side plates 3 may sway up and down during the cleaning. This means that the external force has not been effectively transferred to the two side plates 3. In contrast, as to the foldable spin flat mop 100, both of the two independent cleaning plates 21 are directly connected to the handle 10 via the joint member 24 and the cardan joint member 22, and each of them is rotatable with regard to the handle 10. Accordingly, as shown in FIG. 9, when the foldable spin flat mop 100 is in a cleaning state, i.e., when an external force is exerted on the handle 10, the force is transferred to all of these independent cleaning plates 21, such that all of them can perform the cleaning as a normal flat mop, which means the external force exerted on the handle 10 has been effectively transferred to all of the plates 21. As a result, the foldable spin flat mop 100 of the present invention can achieve a higher cleaning efficiency.

Further, as shown in FIG. 10, the left is the conventional spin flat mop while the right is the foldable spin flat mop 100, both in their dehydration states. For the conventional spin flat mop, when it is in the dehydration state, the three-plate mop head will be transferred into a "U" form to fit onto the rotatable basket 6, but according to the centrifugal dehydration theory, only the microfiber bonnets 5 attached to the side plates 3 which lean against the side wall of the rotatable basket 6 and be farther away from the rotation center can be dehydrated well, while the microfiber bonnet attached to the middle plate 2 usually cannot be fully dehydrated. In contrast, as to the foldable spin flat mop 100, both of the two independent cleaning plates 21 may suitably lean against the side wall of the rotatable basket 502 and be sufficiently far away from the rotation center. As such, the microfiber bonnets (i.e., the cleaning element 30) attached to these independent cleaning plates 21 can be dehydrated effectively. Accordingly, a higher dehydration efficiency can be achieved by the mop.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A foldable spin flat mop, comprising:

a handle; and a mop head connected to said handle, said mop head comprising:

at least two independent cleaning plates being able to form a coplanar and flat cleaning surface; and a connection mechanism disposed to rotatably connect said at least two independent cleaning plates to said handle, said connection mechanism comprising:

a plurality of seats provided respectively at said at least two independent cleaning plates; and at least one joint member connecting the plurality of seats;

wherein each of said at least two independent cleaning plates is rotatable with regard to said joint member, such that said at least two independent cleaning plates each is capable of rotating relative to said handle; and wherein each of said at least one joint member has an "H"-shaped configuration, which includes a straight joint body connected to said handle, and two end joint bodies respectively disposed upon a corresponding one of said at least two independent cleaning plates and respectively connected to the seats of the corresponding one of said at least two independent cleaning plates.

2. The foldable spin flat mop according to claim 1, wherein in each of said at least one joint member, said two end joint bodies each connects with the straight joint body and defines a pivotal axis perpendicular to the straight joint body, and each of said at least two independent cleaning plates is rotatable around its corresponding pivotal axis.

3. The foldable spin flat mop according to claim 2, wherein in each of said at least two independent cleaning plates the distance between the end joint body and the handle is less than the distance between a vertical centre line of the independent cleaning plate and said handle.

4. The foldable spin flat mop according to claim 2, wherein in each of said at least two independent cleaning plates, the distance between the end joint body and the handle is greater than or equal to the distance between a vertical centre line of the independent cleaning plate and the handle.

5. The foldable spin flat mop according to claim 1, said connection mechanism further comprising:

a cardan joint member connecting said joint member to said handle, wherein said cardan joint member is configured to be rotatable around a second axis perpendicular to the straight joint body and extending through the cardan joint member, and be rotatable around the straight joint body.

6. The foldable spin flat mop according to claim 1, further comprises cleaning elements each of which is installed to a corresponding one of said at least two independent cleaning plates.

7. The foldable spin flat mop according to claim 6, wherein each of the cleaning elements comprises a microfiber bonnet.

8. A cleaning tool kit, comprising:

a foldable spin flat mop according to claim 1; and a bucket including a bucket chamber and a rotatable basket disposed in said bucket chamber;

wherein when the mop head of the foldable spin flat mop is placed into the rotatable basket, each of said at least two independent cleaning plates will rotate around its corresponding end joint body to lean against the side wall of the basket, such that once the mop head together with the basket is driven to gyrate, the centrifugal dehydration of the mop head is performed.

* * * * *